United States Patent [19]

Echols

[11] Patent Number: 4,569,097

[45] Date of Patent: Feb. 11, 1986

[54] TUBE CLEANERS

[75] Inventor: Marvin Echols, Houston, Tex.

[73] Assignee: Superior I.D. Tube Cleaners Incorporated, Houston, Tex.

[21] Appl. No.: 554,765

[22] Filed: Nov. 23, 1983

[51] Int. Cl.[4] ..... B08B 9/04

[52] U.S. Cl. ..... 15/104.06 R; 15/3.51; 165/95

[58] Field of Search ..... 15/3.5, 3.51, 3.52, 15/104.06 R, 104.06 A; 134/8; 165/95

[56] References Cited

U.S. PATENT DOCUMENTS 3,277,508 10/1966 Knapp ..... 15/104.06 R 4,083,074 4/1978 Curtis ..... 15/104.06 R

*Primary Examiner*—Edward L. Roberts

*Attorney, Agent, or Firm*—D. Arlon Groves

[57] ABSTRACT

Recirculating tube cleaners pass through inside diameters in a bank of heat exchanger tubes. Variable density tube cleaners are provided which are pressurized to compress and have a substantially neutral buoyancy upon entry from an inlet manifold to the inside diameter of the tubes. Upon exiting from a heat exchanger outlet manifold, the tube cleaners return to either positive or negative buoyancy depending upon the embodiment. Skimmer means intercept tube cleaners having positive buoyancy from the upper portion of flow and direct them to a recirculation system. Open cell elastomer tube cleaners having negative buoyancy may be intercepted at the bottom of the flow and then partially dewatered for adjustment toward neutral buoyancy. As contrasted to prior art embodiments in which the entire outlet flow must be screened, here only a small percentage, for example one percent of the outlet flow, need be intercepted. The tube cleaners are re-entrained in a pumped stream and reintroduced for circulation through the tube bank under pressure. The tube cleaners are made to have a density such that they approach neutral buoyancy for equal distribution through upper and lower tubes. A tube cleaner may be formed of two components, a cleaning component and a buoyancy component. Variation in density in response to pressure may be limited.

6 Claims, 19 Drawing Figures

TUBE CLEANERS

BACKGROUND OF THE INVENTION

The present invention relates to a system for cleaning the inside diameters in a bank of tubes in a heat exchanger system, tube cleaners for use therein and methods for their use.

Heat exchangers of the type contemplated by the present invention comprise condensers utilized in applications such as steam generating power plants. A condenser includes tubes arranged in a tube bundle. Water flowing through the condenser tube bundle picks up heat from condensing steam on a shell side or outside diameters of the tubes. Based on conventional design considerations, a plurality of condensers may be installed in one power plant, each condenser having a large number of tubes. The selection of number of tubes and number of condensers is a function of the design parameters for each system. These design parameters include the amount of water to be pumped through the tubes, the temperature of steam contacting the tubes and various flow rates. According to R. J. Stoker and E. F. Seavey, "The Selection of Large Steam Surface Condensers," *Combustion,* 1967, in a survey of fifty condenser units in a nominal 600 megawatt plant, a nominal flow through the condensers could be 300,000 gallons per minute. In one example, 300,000 square feet of surface area in the condenser are required for cooling. In a nominal design, this surface is provided using tubes 50 feet long and having an outside diameter of one inch. Since maximum surface area is provided by long, small diameter tubes, it is easy to see that individual condensers having 40,000 tubes in a bundle would not be uncommon.

It will be readily apparent that any buildup of coatings inside these tubes or any other fouling will provide the highly disadvantageous effects of buildup and back pressure, making it more difficult to circulate the required large quantities of water through the tubes, and of creating a thermal insulation on the inner surface of the tubes, tending to defeat the very purpose of the heat exchanger itself. Since large quantities of water flow through the tubes and small buildups have a highly disadvantageous effect, online cleaning is very important in maintaining the efficacy and economy of the system. The continuous removal of deposited scale from the insides of the tubes will prevent pitting or concentration cell attack, a form of galvanic corrosion and will prevent further scale deposition. This will further prevent destruction of the tubes. Advantages of a cleaning program are further discussed in "Condenser Cleaning Improves Economics," *Electrical World,* Dec. 15, 1969, page 31, and in A. F. Stegelman and R. Renfftlen, "Online Mechanical Cleaning of Heat Exchangers," *Hydrocarbon Processing,* January 1983, page 95.

An established method of cleaning consists of circulating sponge rubber balls through the heat exchange unit. The balls are forced by pressure to traverse the tubes and each wipe the inside of a tube. While a sponge rubber ball will have only a minor effect on one pass, the balls are commonly maintained in circulation through several hundred or several thousand passes with the objective of cleaning the interior diameter of the tubes. Apparatus must be provided for collecting the sponge rubber balls after they exit from the tubes, conducting them through a recirculation path and reinjecting them into a liquid stream for reintroduction into the tubes. Therefore, the art has developed various forms of cleaners and systems for circulating them repeatedly through tube bundles. The present invention seeks to provide advantages not found in the prior art and elimination of disadvantages as are included in the prior art further discussed here.

Exemplary of many prior art systems is U.S. Pat. No. 2,801,824, issued on Aug. 6, 1957, to J. Taprogge. In the apparatus disclosed therein, condenser tubes are automatically cleaned by cleaning elements comprising "rubbing bodies" which are carried along tube walls by a liquid medium such as the cooling water. The rubbing bodies are moved through the heat exchanger in continuous circulation and intercepted from the outlet of the spent medium by a suitable device and returned again into the fresh liquid medium supplied to and flowing through the heat exchanger. The suitable device comprises a funnel shaped strainer in this apparatus. Another such system is disclosed in U.S. Pat. No. 4,351,387, issued on Sept. 28, 1982, to L. Milia. In the disclosure therein, the suitable device is a sieve means which may be formed as a "V" to intercept the outlet flow from the condenser when the system operates in a mode for recirculating the cleaning means. Alternatively, each leg of the "V" may be rotated so that the two legs are parallel and flow without intercepting the outlet from a condenser when a cleaning operation is not being performed. Many other arrangements are provided in which a means intercepting the entire outlet from the condenser is positioned to intercept the flow and in which the intercepting means may be "feathered" to permit the flow to pass without being screened.

The screens themselves create a pressure drop. They may be subject to clogging, depending on the nature of contaminants found in the cooling water to exacerbate the magnitude of the pressure drop. The above-described construction requires the use of strong, durable screens to withstand the full flow issuing from the condenser. The price of a cleaning system is considerable. In an exemplary 800 megawatt steam generating station built around 1975, a nominal price for the equipment attributable to the system for recirculating cleaning elements, separate and apart from the condensers themselves, was one million dollars. It is desirable to provide a system in which simpler construction is possible and in which it is not necessary to intercept the entire flow issuing from the condenser station.

As to the cleaning balls themselves, many forms have been provided commonly utilizing sponge rubber of a slightly larger dimension than the inner diameter of the tube to be cleaned. Over a large number of recirculating passes through the tubes, the sponge rubber balls tend to remove undesired buildups in the interior of heat exchanger tubes. After separation from the outlet stream from the condenser, the cleaning elements are recirculated. A means for separating worn out balls which are decreased in size prior to delivery to the inlet stream to the condenser may be provided.

The cleaning elements are normally unevenly distributed through the tubes within the banks in a condenser since the cleaning elements are heavier than water when recirculated and returned for introduction into tubes in a condenser. As stated above, there can be up to 40,000 tubes in a bank. Therefore, some tubes in a bundle will be 20 feet higher than others. Turbulence normally encountered in an inlet manifold at the entrances to the tubes will not overcome the effects of gravity on the heavier-than-water cleaning elements in terms of providing for uniform vertical distribution of cleaning elements. Tubes which are vertically above other tubes will therefore tend to have fewer cleaning elements circulating therethrough with uneven cleaning resulting. Consequences can be significant. Upper tubes may not be cleaned effectively and eventually must be mechanically and/or chemically cleaned. Acid cleaning is a known form of cleaning. There is the attendant expense of the cleaning operation and significant "downtime" for the condenser, which often results in the shutting down of the power plant itself.

In circulating, the cleaning elements must strike against the screens, separating sieves or the like, to be removed from the outlet flow and recirculated. The necessary action of this separation reduces the useful life of the cleaning elements. It is desirable to have a system in which separation does not require the rolling of cleaning elements against a screen.

The geometry of the cleaning elements can provide for difficulty and expense in their construction. It is desired to provide for the option of simplifying construction.

Prior art refers to means used for cleaning inner diameters by many different terms, e.g. plug, pig, ball, etc. Such names will be referred to herein as tube cleaners.

SUMMARY OF THE INVENTION

It is therefore an object of the present invention to provide a tube cleaning system for a heat exchanger of the condenser type in which means are provided for intercepting tube cleaners exiting from a condenser without the need for intercepting the entire liquid outlet thereof.

It is a more specific object of the present invention to provide a cleaning system of the type described in which large screens for receiving the entire outlet flow from the heat exchanger for the purpose of removing tube cleaners therefrom are eliminated.

It is a further object of the present invention to provide a heat exchanger tube cleaning system including means for removing tube cleaners from a conduit which may be opened to the atmosphere.

It is also an object of the present invention in one form to provide a system of the type described in which tube cleaners may be removed from outlet flow at ambient pressure, intercepted, channeled to recirculation means entrained in an injection flow by suction and circulated through condenser tubes under pressure.

It is a more specific object of the present invention to provide a system of the type described for cooperation with tube cleaners having a positive buoyancy at a first ambient pressure and neutral or negative buoyancy under increased pressure.

It is a more specific object of the present invention to provide a system of the type described including means for pressurizing a variable buoyancy tube cleaner prior to entry into an inlet manifold of a condenser.

It is a further, separate object of the present invention to provide a tube cleaner comprising a closed cell material which may be pressurized to a selected buoyancy.

It is a more specific object of the present invention to provide a cleaning element of the type described having positive buoyancy at atmospheric pressure and having a compressibility selected so that the tube cleaner may be compressed to achieve a neutral or negative buoyancy at pressure levels expected to be encountered in streams flowing to a heat exchanger for circulating heat exchanger cleaning elements therethrough.

It is another more specific object of the invention to provide in one form a cleaning element structured to have a limit to its increase in density in response to pressure thereto, whereby limited variable density is provided.

It is another object of the present invention, in one form, to provide heat exchanger cleaning elements which are easier to fabricate than spherical sponge rubber balls.

It is a further object of the present invention, in one form, to provide tube cleaners of the type described comprising a combination of a first variable buoyancy member means and second member not of variable buoyancy but for facilitating cleaning, whereby the entire structure is of variable buoyancy.

It is also another more specific object of the invention in one form to provide tube cleaners of the type comprising a buoyancy member and a cleaning member which may be formed to have substantially neutral buoyancy in the above-described application and in which the buoyancy of individual tube cleaners is fixed.

It is another object of the invention, in one form, to provide a system and method utilizing open cell, e.g. sponge rubber, tube cleaners as variable buoyancy members.

Briefly stated, in accordance with the present invention, there are provided a cleaning system for circulating tube cleaners through condenser tubes, tube cleaners and a method for cleaning tube inside diameters in apparatus such as heat exchangers. Vertically disposed means intercept a portion of the flow from an outlet manifold of a condenser and deflect cleaning elements therefrom to conduit means. The conduit means direct cleaning elements to recirculation means and reinjection means which provide the cleaning elements to an inlet manifold for circulation through heat exchange elements. The recirculation means may include separator means for separating worn cleaning elements and may further include a deaeration chamber. Entraining means draw the cleaning elements into a stream and subject them to pressure wherein they are compressed and entrained for entry into the cleaning stream. The tube cleaners are made to have a density such that they approach neutral density under conditions expected to be encountered at the entry to condenser tubes. In one form, cleaning elements comprise closed cell material. An example is polyurethane foam. When compressed, the cleaning element increases in density and decreases in buoyancy. Variation in buoyancy of the tube cleaners may be limited. The cleaning elements are formed so as to float at atmospheric pressure and to reach neutral buoyancy when compressed at expected pressures at the entrance to the heat exchange tubes. These tube cleaners float upon exiting from the outlet manifold. In a novel method, buoyancy of the cleaning elements is varied during the course of recirculation as described above. Further, cleaning elements having a diameter smaller than the inside diameter of the tubes may be inserted intentionally into the flow path for cleaning purposes.

BRIEF DESCRIPTION OF THE DRAWINGS

The means by which the foregoing objects and features of novelty are achieved are pointed with particularity in the claims forming the concluding portion of the specification. The invention, both as to its organization and manner of operation, may be further understood by reference to the following description with the following drawings.

Of the drawings.

DESCRIPTION OF THE PREFERRED EMBODIMENT

Figure 1:
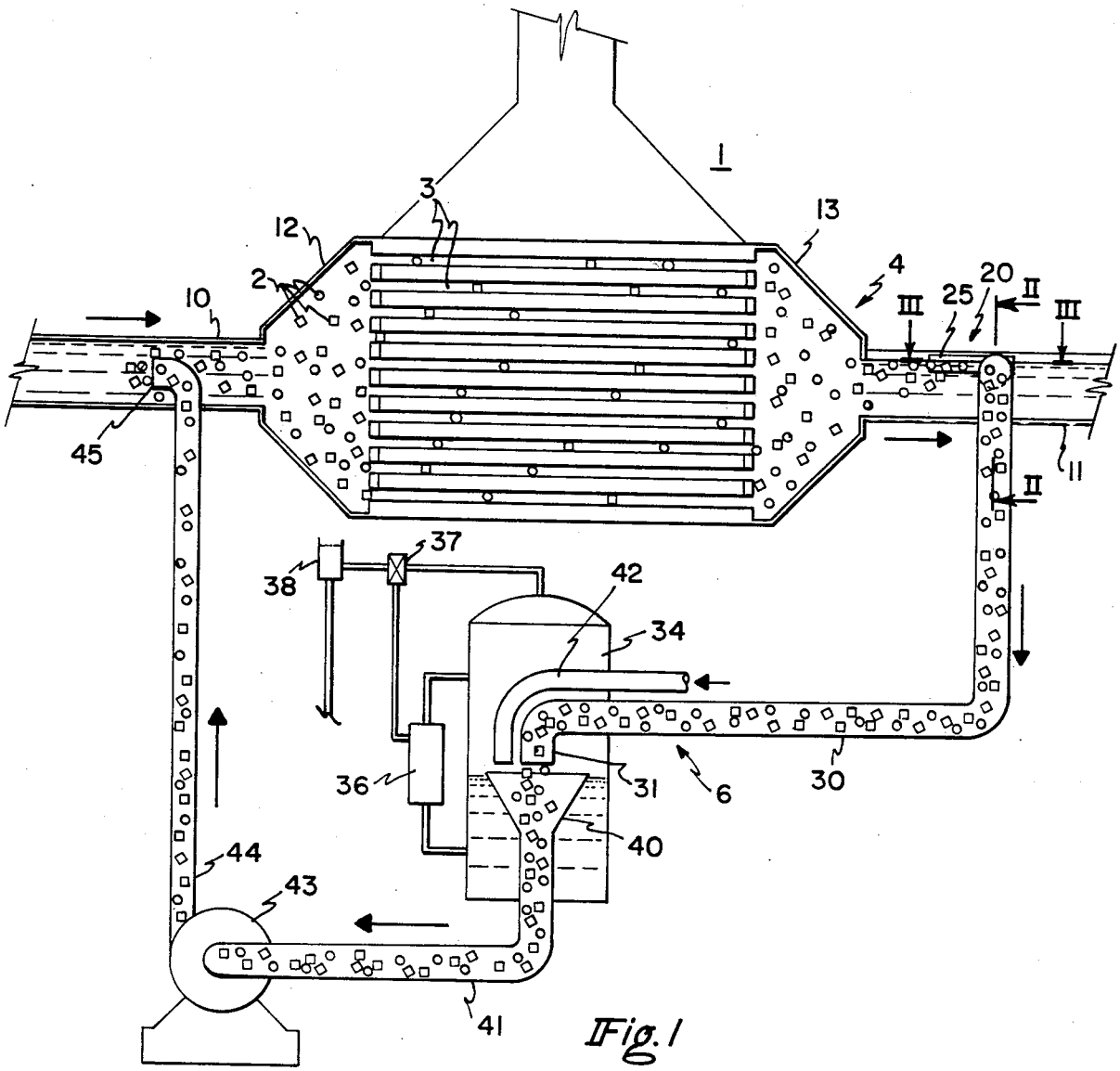
FIG. 1 is a mechanical schematic illustration of a system constructed in accordance with the present invention and incorporating a condenser stage for cleaning inner diameters of tubes in the heat exchanger.

FIG. 1 is an elevation in schematic and partically in cross-sectional form of a system 1 in which tube cleaners elements 2 are circulated to clean inside diameters of tubes 3 in a condenser 4. A recirculation system 6 is operable to selectively return tube cleaners 2 which exit from the condenser 4 to the inlet thereof.

The supply of cooling water is provided from an inlet conduit 10. The inlet conduit 10 can supply cooling water from a river, lake or other source. It should be realized that cooling water is an example of one suitable form of cooling fluid medium which can be circulated through the present system. Other media may be utilized. However, water will most commonly be provided in embodiments in which the condenser 4 is included in a steam power generating plant. Cooling water enters an inlet distribution head 12 communicating with the entry to each tube 3.

An outlet conduit 11 receives cooling water from an outlet collection head 13 communicating with the tubes 3 and discharges the cooling water. The outlet conduit 11 also communicates with the recirculation system 6. The outlet conduit 11 may comprise a pipe, tunnel or an open trough or flume. The illustration in FIG. 1 is intended to be representative of either. The cross-section of the outlet conduit 11 at FIG. 1 may be either square or circular. Commonly, an open trough or tunnel will have a rectangular cross-section, and a pipe will have a circular cross-section.

Figure 2:
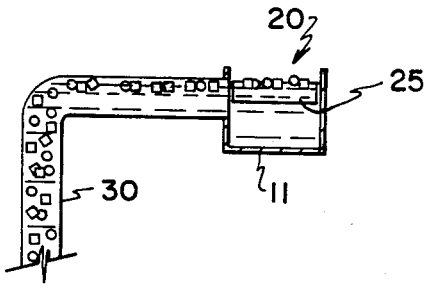
FIG. 2 is a partial elevation in cross-sectional form taken along lines II—II of FIG. 1 illustrating means for separating cleaning elements from the outlet flow from the heat exchanger.
Figure 3:
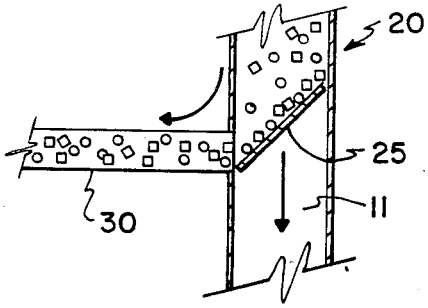
FIG. 3 is a sectional plan view of the means illustrated in FIG. 2 and is taken along lines III—III of FIG. 1.

FIGS. 2 and 3, which are partial cross-sectional illustrations of an elevation and a plan respectively along Lines 2—2 and 3—3 of FIG. 1 illustrate one form of the interface between the outlet conduit 11 and the recirculation system 6. The interface means 20 comprises a barrier 25 for intercepting flow in the outlet conduit 11 in a manner described in further detail below and directing a portion thereof to a conduit 30 having an outlet 31 terminating in a deaeration tank 34. The deaeration tank 34 is of conventional construction including a liquid level controller 36 for controlling water level in the tank 34 by controlling valve means 37 operating pressure means 38. The deaerating tank 34 is operated in a conventional manner. The pressure means 38 which may supply negative pressures such as a vacuum is operated to draw air off from the tank 34. In this manner, air is removed from the flow that is to be returned through the remainder of the recirculation system 6.

Within the aerating tank 34 is an inlet 40 to a conduit 41 which conducts water and material entrained therein (such as tube cleaners 2) from the deaerating tank 34 pumped by a pump 43 to a conduit 44. A source 42 of make-up water is provided to provide a sufficient stream into which to entrain, pressurize and reinject the tube cleaners 2. The conduit 44 has an outlet 45 for injecting tube cleaners 2 in the flow path to the inlet 10 of the heat exchanger 1.

Referring to FIGS. 2 and 3, the interface means 20 is discussed in greater detail. In accordance with this embodiment of the present invention, variable buoyancy tube cleaners 2 are utilized which will have positive buoyancy upon reaching the outlet manifold 4 and outlet 11. In the prior art systems wherein the exiting tube cleaners have negative buoyancy, it is the standard practice to intercept the entire flow in an outlet analogous to the outlet 11 to remove tube cleaners therefrom. In accordance with the present invention, however, the barrier 25 is formed to provide skimmer means positioned for intercepting a vertical extreme portion of flow in a horizontal component of the flow direction from the outlet collection head 13. The barrier 25 is preferably a straight, rectangularly shaped wall member. Where fitted into a circular pipe, however, the barrier 25 may be a V-shaped barrier when viewed in a direction normal to outlet flow and comprising first and second radial flanges. In the present embodiment in which tube cleaners 2 are expected to float upon exiting from the outlet collection head 13, the barrier 25 is positioned extending across a top portion of the outlet 11. As used here, "top portion" contemplates a depth which corresponds to the expected depth to which tube cleaners are expected to be encountered. The barrier 25 is preferably positioned a distance from the outlet collection head 13 such that tube cleaners 2 will have an opportunity to float to the top of the water flow. It is significant that the barrier 25 and outlet conduit 30 may be formed to provide a minor portion, for example, as little as one or two percent of the outlet flow in the outlet 11 to the recirculation system 6.

This proportioning provides for a number of highly beneficial results. The barrier 25 may be of solid construction, such as a solid piece of steel. The barrier may be made at minimum cost to provide maximum strength. This is to be contrasted with extremely expensive and complex screen systems of the prior art. A screen system is of necessity difficult to provide in that a screen must be open enough to permit flow therethrough and yet must be strong enough to withstand the differential pressure thereacross. A screen also necessarily creates a back-pressure. Such a back-pressure is not produced by the present barrier system in an open flume. The back-pressure produced in a closed pipe embodiment is not significant since only a minority of the area of the cross-section of the pipe need be blocked. This is extremely significant since in a nominal embodiment in an 800 megawatt power plant, for example, outlet flow in a nominal outlet pipe 11 may be 140,000 gallons per minute.

The barrier 25 preferably extends to a point at which the conduit 30 intersects the outlet 11. From that point, the barrier 25 is angled with respect to the horizontal component of flow in the pipe 11. As the tube cleaners 2 are carried along in the flow and impact the barrier 25, the tube cleaners 2 are directed to the conduit 30. The angle at which the barrier 25 is placed with respect to the flow may be, for example, 45°. An optimal angle may be selected as a function of the geometry or geometries of the tube cleaners 2. As further described below, the tube cleaners may not necessarily all be spherical. Further, different geometries of tube cleaners may be combined in the flow. The optimum angle is a function of the combination of tube cleaners 2 provided in the flow. One skilled in the art will know when the optimum angle is achieved in that the maximum number of tube cleaners reach the conduit 30 after striking the barrier 25 in a minimum time.

The conduit 30 receives a flow of water and tube cleaners 2 and provides the flow to the deaeration tank 34. The pump 43 pumps flow therefrom. The tube cleaners 2 are entrained in the flow under pressure. The tube cleaners 2 as entrained in the flow are then injected from the outlet 45 into the stream entering the inlet 10. Tube cleaners 2 are then dispersed throughout the inlet distribution head 12. The pressurization of the tube cleaners 2 to substantial neutral buoyancy is highly useful in that it helps assure a substantially even distribution of tube cleaners to all the tubes 3 in the heat exchanger 4. Turbulence in the inlet distribution head 12 further disperses the tube cleaners 2. In a nominal heat exchanger, the inlet distribution head 12 may be as high as 20 feet to accommodate all 40,000 tubes. This has resulted in prior art, conventional tube cleaning operations being relatively ineffective as applied to the upper tubes.

The tube cleaners 2 are forced under pressure through the tubes 3. The tube cleaners 2 rub thereagainst. Only a minimum amount of cleaning takes place on one pass. It is contemplated that the tube cleaners 2 will be recirculated continuously through the heat exchanger except during cleaning system outages.

FIGS. 4–17 are isometric illustrations of tube cleaners which are susceptible of optimal use in the present embodiment. The common feature is that each tube cleaner comprises a closed cell or closed cell material. The closed cell material is preferably an elastomer. An example of a closed cell material is polyurethane foam. This is to be contrasted with the common, open cell, sponge rubber tube cleaner of the prior art. The optimal density of foam material will be dictated by the expected application. For example, in the preferred embodiment, it is desired that a material is selected that is pressurized to neutral buoyancy at the average pressure expected to be encountered at the entries to the tubes 3.

Neutral, or zero, buoyancy here is used to indicate a nominal, preselected degree of buoyancy which in some embodiments will actually equal neutral buoyancy and in other embodiments will closely approximate this value. Neutral buoyancy is achieved when density of a tube cleaner 2 equals density of the surrounding water. The tube cleaners 2 are designed to have a given density at a given pressure. This density is the density of water expected to be encountered at entries to tubes 3. The water density will vary, however, with temperature. Water is densest at 39.2° F. (4° C.). Also, densities of individual tube cleaners will vary within a group due to manufacturing tolerances. The terminology neutral density may therefore also refer herein to a tube cleaner 2 being in a group of tube cleaners whose average density will provide for the nominal value of buoyancy referred to as neutral buoyancy. The range of values of densities in the group may be minimized through manufacturing controls. Alternatively, it may be desired to broaden the range of permissible densities. The objective sought is equal distribution of tube cleaners 2 through the tubes 3.

The material is one that floats at the pressure expected in the outlet 11, e.g. at ambient pressure. The examples in FIGS. 4–15 are not exhaustive. They are only exemplary to teach those skilled in the art how to make many different forms of tube cleaners, many of which will be constructed in accordance with the present invention.

Figure 4:
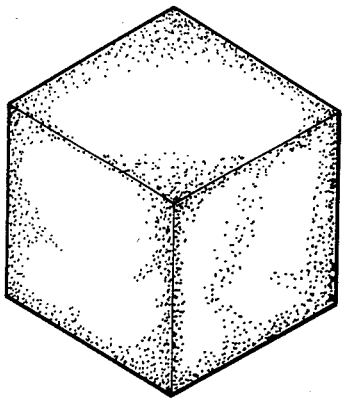
FIGS. 4 and 5 are isometric illustrations of tube cleaners constructed in accordance with the present invention consisting of closed cell material, FIG. 5 being partially broken away.
Figure 5:
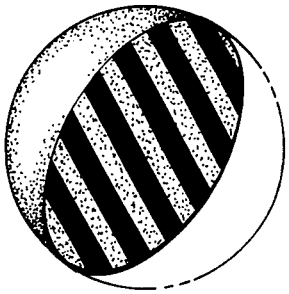

FIGS. 4 and 5 illustrate closed cell elastomeric tube cleaners in a cubic and spherical configuration respectively. FIG. 5 is partially broken away to illustrate interior structure. These tube cleaners may be made of rubber. The elastomer is of the closed cell type. This is to be contrasted with open cell sponge rubber. Further, for more severe cleaning requirements, as illustrated in FIG. 5, carbon black or other abrasive may be dispersed throughout the tube cleaner.

In accordance with the present invention, the tube cleaner may be cubic, as shown in FIG. 4. It has been found that in multiple recirculations of a tube cleaner 2, points of the cube will be deformed to permit passage of a cubical tube cleaner through a heat exchanger tube. One edge of the cube is selected to be slightly larger than the inner diameter of a tube 3. Manufacture of cubical tube cleaners 2 is simplified and less expensive compared to manufacture of the traditional spherical tube cleaners, as shown in FIG. 5 in cross-sectional form.

Figure 6:
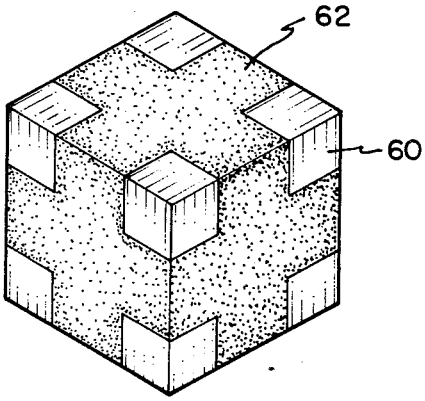
FIGS. 6 through 9 illustrate additional geometrical configurations of tube cleaners and cleaning elements comprised of both single buoyancy material for cleaning combined with pressure-variable buoyancy material.
Figure 7:
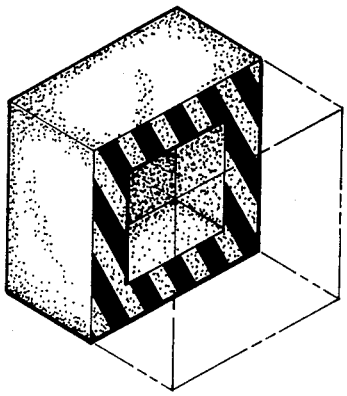
Figure 8A:
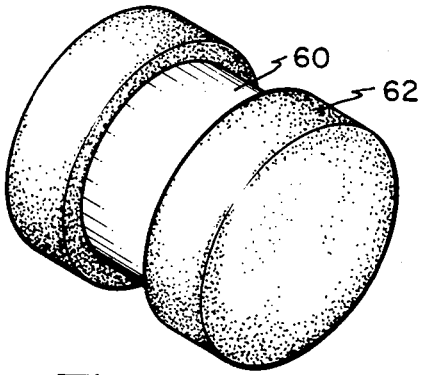
Figure 8:
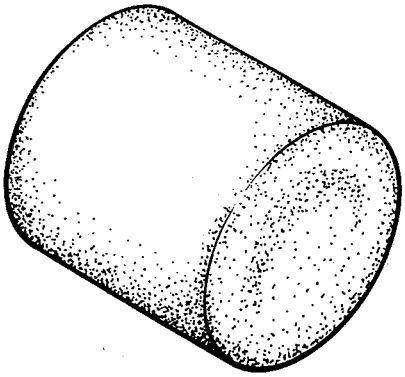

FIG. 6 is illustrative of a tube cleaner 2 in a cubical configuration incorporating flotation members 60, which may be, for example, polyurethane foam and an abrasive or cleaning member 62 comprising the remainder of the tube cleaner. As illustrated in FIG. 7, a hollow tube could also be provided. FIG. 8 illustrates another non-traditional shape for a tube cleaner, namely, a cylinder. In the embodiment of FIG. 8, elastomer is formed as a right circular cylinder. Again, the diameter of the right circular cylinder is selected to be slightly larger than the tube 3. The cylinders will tend to orient themselves within the inlet distribution head 12 at the point of entry to the tubes 3 for proper transport through the tubes. FIG. 8*a* comprises a cylindrical flotation member 60 having a smaller diameter than the cylinder of FIG. 8 and having cleaning members 62 mounted thereon. Cleaning members here and below may comprise medium durometer elastomer.

Figure 9:
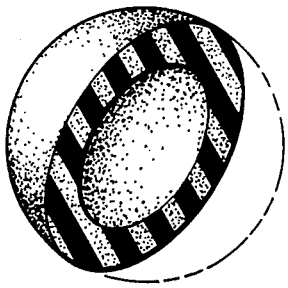

FIG. 9 is illustrative of a hollow spherical tube cleaner. The elastomeric material may comprise the closed cell, compressible material for providing variable buoyancy. Alternatively, the sphere itself may be compressed as a unit as opposed to collective compression of the individual closed cells therein.

Figure 10:
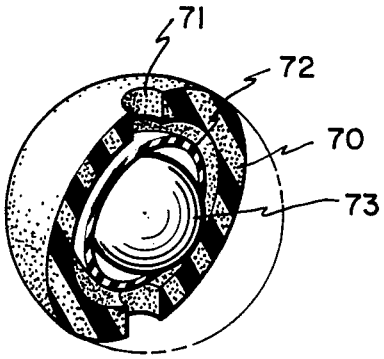
FIGS. 10 and 11 are isometric illustrations, in partially cross-sectional form, of tube cleaners utilizing compressible gas as a variable density means.
Figure 11:
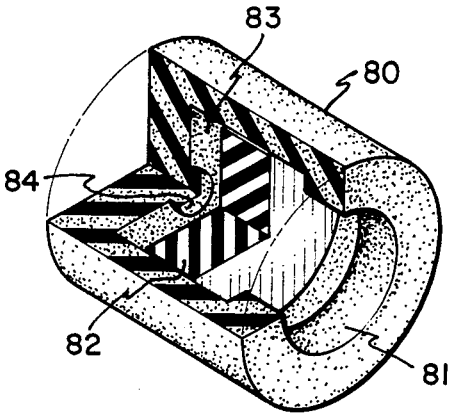

FIGS. 10 and 11 illustrate tube cleaners 2 having alternative methods to respond to increases in pressure to decrease the buoyancy thereof, namely provision for limited variable buoyancy. In FIG. 10, the tube cleaner 2 comprises a hollow, spherical body 70 having ports 71 communicating with an interior of the body 70. The ports 71 permit transmission of pressure from the exterior of the sphere 70 to the interior thereof. Mounted within the interior of the body 70 is a membrane 72 surrounding a core 73. Between the solid core 73 and the membrane 72 is a compressible fluid. The compressible fluid may comprise inert gas or condensible gas. At atmospheric pressure, the membrane 72 expands to a first diameter dependent on the size of the membrane itself and positively limited by the inner diameter of the hollow sphere 70. As pressure transmitted through the ports 71 increases, the diameter of the membrane 72 decreases. The maximum contraction is limited by the volume of the core 73. The core 73 must be porous so as to permit compression of the gas housed within the membrane 72 into the core 73. A limit on the compression of the membrane 72 is provided. In this manner, a form of tube cleaner 2 is provided having limited variable buoyancy. Buoyancy of the tube cleaner 2 in this embodiment decreases as pressure thereon increases until the membrane 72 is compressed to the size of the core 73. Thereafter, increase in pressure does not decrease buoyancy. By proper proportioning of dimensions and component densities, the tube cleaner 2 of the present embodiment can be constructed such that the tube cleaner 2 will have neutral buoyancy at any pressure over a selected threshold pressure, which threshold pressure can be one expected to be encountered in the inlet distribution head 12 to the heat exchanger 1.

Another variable buoyancy tube cleaner 2 may be provided as in FIG. 11, which is an isometric view of a right circular cylinder embodiment, partially broken away. A right circular cylinder 80 is provided having a port 81 communicating pressure to a piston 82 housed therein defining an enclosed portion 83 enclosing a compressible fluid as in the embodiment of FIG. 10. A stop means 84 may be provided to limit travel of the piston 82 and compression of the fluid in the portion 83. Once again, a maximum density is provided for irrespective of pressure over a selected threshold level.

Figure 12:
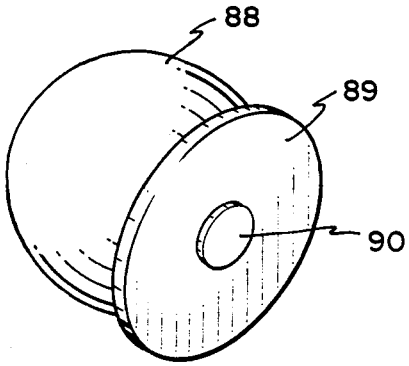
FIGS. 12–17 are isometric illustrations of further configurations of suitable tube cleaners constructed in accordance with the present invention.

FIG. 12 is an isometric illustration of an embodiment in which a compressible flotation member 88 and a relatively incompressible cleaning member 89 affixed thereto by fastening means 90 is provided. The flotation member 88 is shaped to fit for travel through a tube 3. An annular cleaning member 89 affixed thereto has a diameter selected to be slightly larger than that of a nominal inside diameter of a tube 3. In the embodiment of FIG. 12, the flotation member 88 comprises a truncated spheroid having the annular member 89 mating to the truncated portion thereof. The fastening means 90 extends through the center of the cleaning member 89 into the flotation member 88 along a diameter thereof. Edges of the outer diameter of either annulus 89 may be rounded. Alternatively, they may be initially left square for ease in manufacture and will be rounded upon progressing through repeated passes through the heat exchanger tubes 3.

Figure 13:
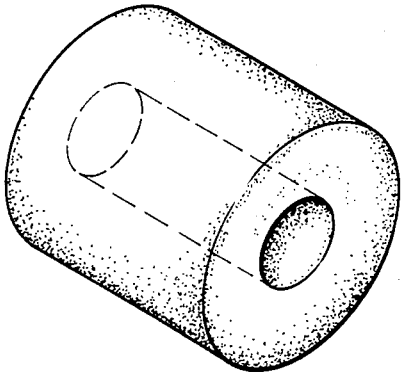
Figure 14:
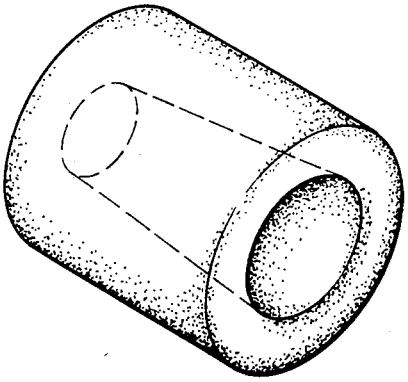
Figure 15:
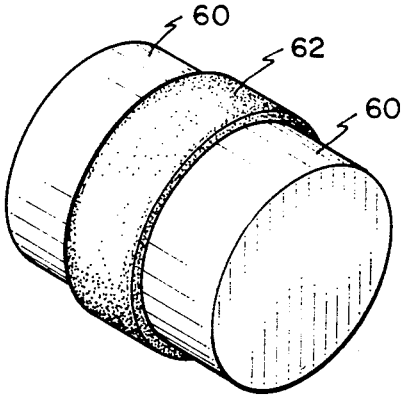

FIGS. 13 and 14 disclose alternative embodiments of the embodiment of FIG. 8 in which a central opening is provided which decreases differential pressure across each cleaning element 2. The central opening may comprise a right circular cylinder, truncated cone or other convenient shape. FIG. 15 further illustrates a central body 60 surrounded by an abrasive annular member 62.

Figure 16:
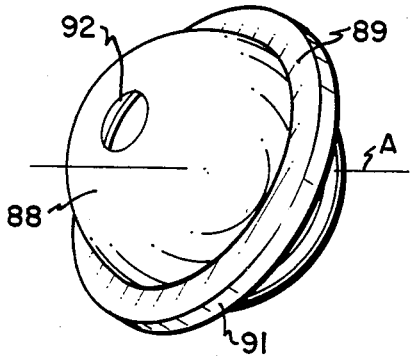
Figure 17:
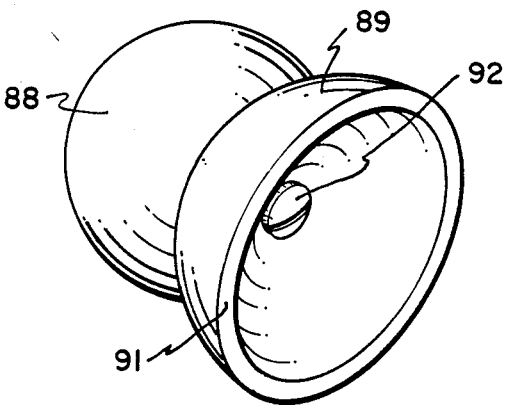

FIGS. 16 and 17 represent a special case of the above embodiments in which the range of variability of buoyancy in response to pressure is zero. A flotation member 88 is provided which is substantially incompressible under expected pressures. The flotation member 88 and cleaning member 89 are proportioned to provide for neutral buoyancy. The cleaning member 89 is of an elastomer of high abrasion resistance and high flex failure resistance, e.g. polyurethane. In the embodiment of FIG. 16, the flotation member 88 may be bifurcated to abut opposite surfaces of the cleaning member 89 which is mounted in a plane on a diameter of the member 88, e.g. as to resemble the planet Saturn. To provide for the same result, the flotation member 88 may have a groove formed in its cicumference. The cleaning member 89 may be stretched over the flotation member 88 and snap into place in the groove. The cleaning member 89 is supported in the flotation member 88 and has only an annular peripheral portion projecting in a radial direction from the spheroid defined by the flotation member 88. In the embodiment of FIG. 17, the flotation member 88 is a sphere, and the cleaning member 89 is a deformable disc attached to and depending from the flotation member 88. The disc comprising the cleaning member 88 is deformable to form a convex surface in the direction of travel. Both embodiments are oriented in each tube 3 by hydraulic forces. Fastening means 92 maintain the members 88 and 89 in engagement. In FIG. 17, the fastening means 92 is engaged to the flotation member 88 sufficiently tightly to initiate the above-described cup-like deformation of the disc i.e., the cleaning member 89. The fastening means 92 need not be a screw; it could comprise a molded retaining means integral with the flotation member 88.

In both cases, the flotation member 88 has a longest dimension less than an inside diameter of a tube 3 through which it is intended to travel and the cleaning member 89 has a greater diameter. The cleaning member 89 is sufficiently elastomeric such that a side 91 seals thereof the inside diameter of a tube 3 and provides a wiping motion of its periphery against the inside diameter as the tube cleaner 2 moves in response to the pressure differential thereacross. The cleaning member 89 thus engages the tubes in a cleaning relationship. The side 91 may initially be squared and eventually become rounded due to wear.

The diameter of the cleaning member 89 in the embodiment of FIG. 16 is chosen so that the cleaning member 89 will be other than normal to an axis of a tube 3, illustrated as axis A in FIG. 16, and will assume differing orientations in successive passes. Ideally, the tube cleaner 2 will rotate about the axis of the tube 3. In the embodiment of FIG. 17, greater deformability of the cleaning member 89 is provided for, and the cleaning member 89 forms a cup upon entry into a tube 3. The material and diameter of the cleaning member 89 are selected so that the cup "wobbles" in its travel through the tube 3 so that cleaning action is enhanced.

Figure 18:
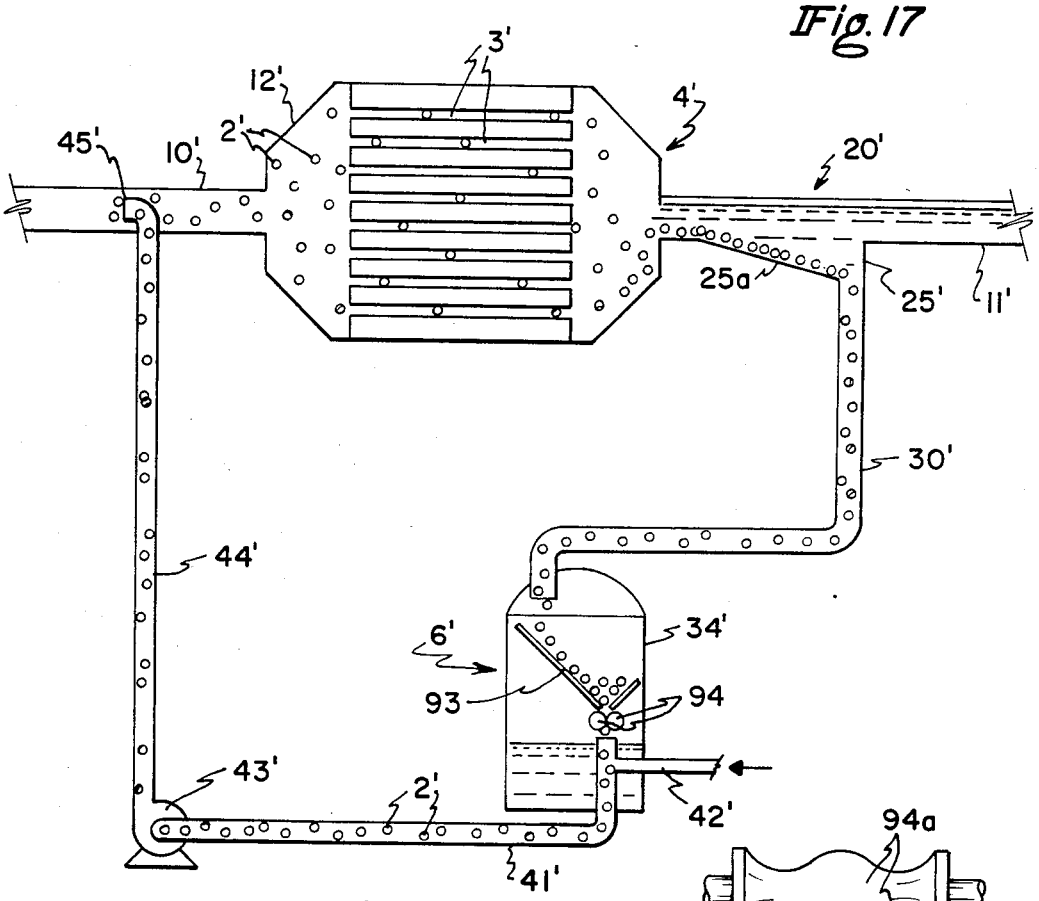
FIGS. 18 and 19 illustrate a system utilizing open cell tube cleaners in accordance with the present invention.

FIG. 18 is a mechanical schematic illustration partially illustrating a further embodiment of the system as illustrated in FIG. 1. Element in FIG. 18 corresponding to elements in FIG. 1 are denoted by similar reference numerals with a prime notation. In this embodiment as well, tube cleaners 2' are intercepted by skimmer means in a horizontal component of direction of flow from an outlet and directed to recirculating means. It is realized that the term "skimming" is most commonly utilized in connection with removal from the top of a liquid body.

Here, it is used to indicate removal from a vertical extreme portion, which in the embodiment of FIG. 18 happens to be a lower vertical extremity, namely the bottom. Another form of skimming means for cleaner retrieval from the bottom of the flow could comprise a settling basin. The difference in buoyancy upon exiting from a heat exchanger from that upon entering a heat exchanger is once again used for separating the tube cleaners 2' from the outlet flow and for avoiding the need to intercept the entire outlet flow volume for the purpose of separation. In the embodiment of FIG. 18, however, the tube cleaner 2' utilized is an open cell tube cleaner. The open cell tube cleaner 2' may be of known tube cleaning material such as sponge rubber or other suitable elastomer and having a porosity which provides for suitable operation. Suitable operation is that which permits operation in accordance with the details described below.

Referring in greater detail to FIG. 18, an interface 20' is provided at the outlet 11' which, once again, may be either an open flume or a closed pipe. In the present embodiment, use of open cell tube cleaners 2' is contemplated. The tube cleaners 2' contain air upon entry into tubes 3. Air is expelled from tube cleaners 2' by reintroduction of water into the cellular construction thereof under the differential pressure thereacross. Upon exiting from the heat exchanger 1, the tube cleaners will sink. The direction of travel will be in a horizontal direction and along the bottom of the outlet 11'. At the interface 20', a separator section 25' is formed such that tube cleaners 2' will be positioned for being intercepted in the horizontal direction of flow by a barrier means and diverted to a conduit 30' in a recirculation system 6'. For example, a barrier means 25' may comprise a vertical wall extending from a lower portion of the outlet 11. An inclined section **25*a* may be provided for permitting tube cleaners 2' to sink below the level of the lower wall of the outlet 11 so that continuing in their horizontal direction of travel they will impact the vertical wall portion 25'**.

From the conduit 30', the tube cleaners 2' travel to a dewatering tank 34'. In the tank 34', the tube cleaners 2' are delivered to an inclined screen 93 for directing the tube cleaners 2' to dewatering rollers 94. The screen 93 as illustrated in FIG. 18, could be either a conical screen having the rollers 94 positioned immediately below a central, circular opening thereof. Alternatively, the screen 93 could comprise the V-shaped intersection of planar surfaces within the contour of the tank 34', and the rollers 94 may be elongated, extending along a maximum dimension parallel to a diameter of the tank 34'. The tube cleaners 2' exit via the conduit 41' for pumping by the pump 43' to the return conduit 44' and injection into the inlet stream as in the embodiment of FIG. 1.

The porous tube cleaners 2' are partially dewatered, i.e., water is removed to a preselected degree upon passage through the rollers 94. The tube cleaners 2' are not completely saturated upon their entry into the inlet distribution head 12. The degree to which the tube cleaners 2' are dewatered by the rollers 94 will be determinative of its buoyancy upon entry into the inlet distribution head 12. As in the embodiment of FIG. 1, a neutral buoyancy is desired. This is because, in the presence of anticipated turbulence, a more uniform distribution of the vertical positions of tube cleaners 2' upon entry into the tube bundle 3 is achieved.

Figure 19:
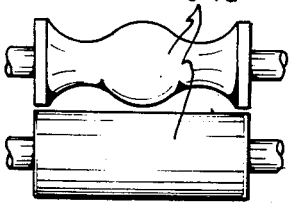

In a further embodiment, the rollers **94*a* may be provided in place of rollers 94 as shown in FIG. 19. Two counter-rotating rollers are provided wherein the distance between the two surfaces is variable. The diameter of each roller 94*a* varies with distance along its axis of rotation. Consequently, the degree of dewatering of tube cleaners 2' will vary with the axial position with respect to the rollers 94 at which the tube cleaners 2' passed therethrough. Consequently, tube cleaners 2' will enter the inlet distribution head 12 having a distribution of buoyancies. This will aid the vertical distribution of tube cleaners 2 prior to entry into the tubes 3 and yield a more even dispersion. It is to be remembered that a nominal heat exchanger 1** may be 20 feet in height. In the common, prior art embodiment, better cleaning is achieved in the lower tubes and poor or no cleaning is achieved in the upper tubes.

Further in accordance with an alternative form of the present invention, the tube cleaners 2 may be selected to have a longest dimension which is less than the inside diameter of a tube in the bundle 3. In the case of a spherical tube cleaner 2, this longest dimension would be a diameter of tube cleaner. For the sake of comprehensiveness in terminology, in the present description, the term diameter is used to mean the longest dimension of a tube cleaner 2, whether or not it is spherical. The present invention further comprises the method of injecting tube cleaners 2 for recirculation, which tube cleaners 2 have diameters smaller than the inner diameters of tubes in the bundle 3. Whereas in the typical prior art embodiments discussed, sponge rubber tube cleaners are provided having a diameter slightly larger so that cleaning is achieved by rubbing action, an embodiment of the present invention contemplates cleaning due to impact of tube cleaners 2 against inner surfaces. It is contemplated that turbulence will propel tube cleaners 2 against the surfaces of the tubes in the bundle 3. Tube cleaners 2 such as in the embodiment of FIG. 5 may be provided of sufficient compressibility to have variable density in accordance with the above teachings while having sufficient hardness to achieve a cleaning effect. It is to be remembered that in the abrasive embodiment or in the non-abrasive embodiment, only a highly limited amount of cleaning need be achieved on each pass of tube cleaners 2 through the tube bundle 3 since in a typical continuous cleaning operation there will be for example ten thousand passes of tube cleaners 2 through a tube 3 per year.

What is thus provided by the present invention are novel tube cleaners of variable density or of limited variable density, novel neutral buoyancy tube cleaners, novel recirculation systems for utilizing either open cell or closed cell variable density tube cleaners and a system and method of utilizing tube cleaners in a novel system.

What is claimed as new and desired to be secured by Letters Patent of the United States is:

1. A tube cleaner for cleaning the inside diameter of a tube, said tube cleaner comprising a cleaning member having negative buoyancy and a flotation member having positive buoyancy, said cleaning member and said flotation member being proportioned to provide neutral buoyancy of said tube cleaner, means maintaining said flotation member to said cleaning member, said cleaning member being dimensioned for forming a seal with the tube whereby said cleaning member engages the tube in a sealing relationship, is oriented by hydraulic force and is moved through the tube in response to pressure differential thereacross.

2. A tube cleaner according to claim 1 wherein said flotation member comprises portions defining a spheroid and surrounding said cleaning component and whereby said cleaning member comprises a disc having an annular peripheral portion extending radially beyond said flotation member.

3. A tube cleaner according to claim 2 wherein said cleaning member has a diameter proportioned with respect to the tube inside diameter such that said cleaning member is disposed at an angle other than perpendicular to an axis of the tube and is positioned for rotation about the axis.

4. A tube cleaner according to claim 1 wherein said cleaning member comprises a disc depending from said flotation member of a diameter for forming a cup convex in the direction of travel when said tube cleaner is positioned in the tube.

5. A tube cleaner according to claim 4 wherein said means maintaining said cleaning member to said flotation member comprises a fastener extending through said cleaning member and into said buoyancy member and tightened sufficiently to induce deformation of said cleaning member.

6. A tube cleaner according to any one of claims 1 through 5 wherein said cleaning member comprises elastomer having abrasive dispersed therethrough.

* * * * *